US008389840B2

(12) United States Patent
Braun

(10) Patent No.: US 8,389,840 B2
(45) Date of Patent: Mar. 5, 2013

(54) PICCOLO

(75) Inventor: Anton Braun, Egelsbach (DE)

(73) Assignee: Anton Braun, Egelsbach (DE)

( * ) Notice: Subject to any disclaimer, the term of this patent is extended or adjusted under 35 U.S.C. 154(b) by 0 days.

(21) Appl. No.: 13/165,869

(22) Filed: Jun. 22, 2011

(65) Prior Publication Data

US 2012/0011987 A1 Jan. 19, 2012

(30) Foreign Application Priority Data

Jul. 17, 2010 (DE) ..... 10 2010 027 462
Jan. 31, 2011 (DE) ..... 10 2011 010 124

(51) Int. Cl.
*G10D 7/02* (2006.01)

(52) U.S. Cl. ..... 84/384

(58) Field of Classification Search ..... 84/380 R, 84/384, 385 A, 386
See application file for complete search history.

(56) References Cited

U.S. PATENT DOCUMENTS 4,714,000 A 12/1987 Braun
2009/0293701 A1 * 12/2009 Rozier ..... 84/384

FOREIGN PATENT DOCUMENTS

DE 3502842 A1 7/1986
DE 29804326 U1 5/1998
DE 19810520 A1 9/1999

OTHER PUBLICATIONS http://www.powerhousemuseum.com/collection/database/?irn=352266&search, 2005.*
Otto Steinkopf, Zur Akustik der Biasinstrumente (On the acoustics of wind instruments), 1983, pp. 26, 40-41, 47 and 81, Edition No. 4029, Moeck Verlag + Musikinstrumentenwerk, Celle.

* cited by examiner

*Primary Examiner* — Kimberly Lockett
(74) *Attorney, Agent, or Firm* — Leydig, Voit & Mayer, Ltd.

(57) ABSTRACT

A piccolo includes a cylindrical headjoint with an embouchure, a stopper including an adjustable seal disposed in a free end of the cylindrical headjoint, and a conical body having tone holes. The tone holes include a single tone hole corresponding to $c^2$ and an end tone hole at a free end of the conical body. The end tone hole is lower than the note $d^1$ and extends at least to the note $c^1$.

5 Claims, 1 Drawing Sheet

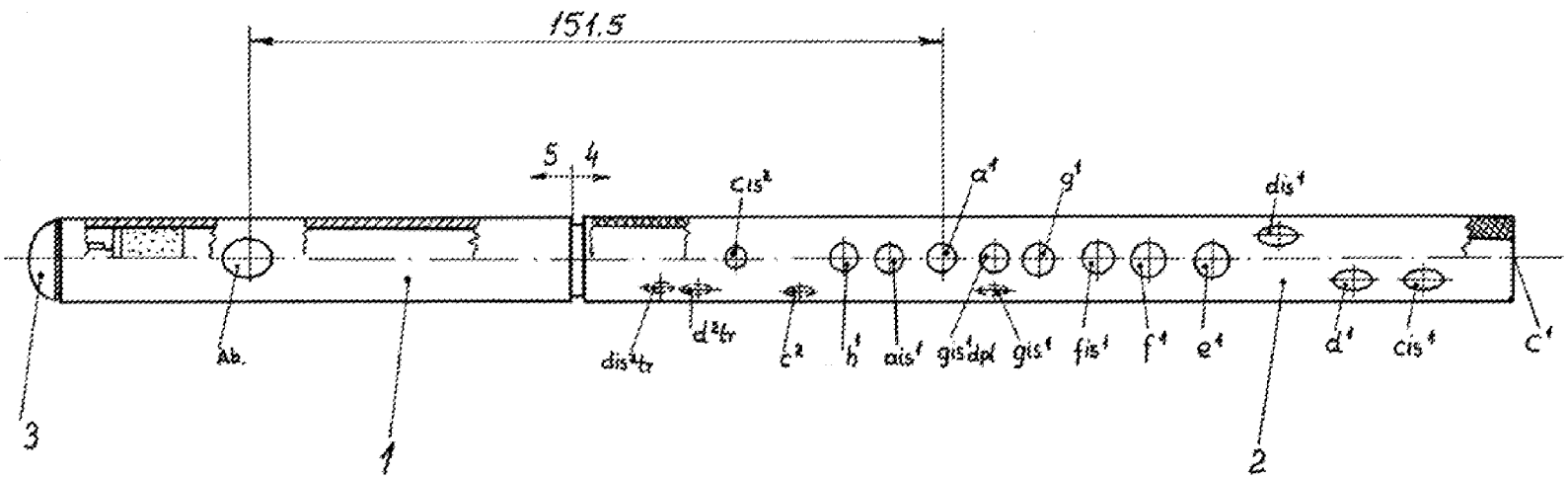
151,5
5
4
1
2
3
c'
cis'
d'
dis'
e'
f'
fis'
g'
gis'
a'
ais'
h'
c²
cis²
d²
dis²

PICCOLO

CROSS REFERENCE TO RELATED APPLICATIONS

This application claims priority to German Patent Application No. DE 10 2010 027 462.3, filed Jul. 17, 2010 and German Patent Application No. DE 10 2011 010 124.1, filed Jan. 31, 2011, which are both hereby incorporated by reference herein in their entireties.

FIELD

The present invention relates to a piccolo including a cylindrical headjoint with an embouchure, a stopper with an adjustable seal at its free end and a conical body with tone holes

BACKGROUND

The concert flute or orchestral Boehm flute used by flautists has a conical headjoint and a cylindrical body. With the current state of technology the piccolo, which sounds an octave higher and also belongs to the family of orchestral Boehm flutes, uses one of the following two designs:

1. For classical music—including symphony and chamber orchestras—it always has a conical body and a cylindrical headjoint (the so-called conical Boehm piccolo), which extends to low d (d1). This is currently the most common design.

Older designs, for example German Patent No. DE 3502842, have two thumb holes, and more recent designs one thumb hole which fixes the shortcomings associated with the two thumb holes concerning acoustic, phonetic and speech in the third octave (register). There have been experimental designs extending to low c ($c^1$) and with a double $c^2$ (sounding $c^3$) thumb hole, but they have featured a poor response and intonation, and unevenness between the registers. They have been rejected by musicians and have not become established.

Or

2. For marching music and brass bands/orchestras the piccolo has a cylindrical body and a conical headjoint (the so-called cylindrical Boehm piccolo). This model uses one of two designs: firstly with two thumb holes and extending to low d ($d^1$) and low c ($c^1$). Secondly with one thumb hole and extending to low c (c1), as described in German-Patent No. DE 19810520.

The explanation for the different main uses is to be found in human perception of sound.

The timbre is determined by the overtone structure, i.e. its composition and the strengths of the different overtones, and is affected by the geometrical shape of the tube. There is thus a fundamental difference in timbre and overtone structure between so-called cylindrical flutes and so-called conical flutes. Whilst cylindrical instruments can produce the entire overtone series more or less strongly and without any gaps, the overtone structure of conical instruments is somewhat restricted to the odd-numbered partials. The high register of conical instruments thus sounds more pleasant to the human ear and is therefore preferred for classical music.

The conical piccolo flutes differ from the cylindrical piccolo flutes in terms of acoustic. By the conical narrowing the piccolos become a little deeper and must therefore be, compared to the cylindrical piccolo flutes, made somewhat shorter. Accordingly the tone holes must be placed a little higher to the embouchure. The way to find the exact measurements of the shortening or the distances between the embouchure and tone holes, is the empirical or experimentally. Speculative calculations would be too vague here, because it is important to note that the tone holes serve not only as tone holes but also have sound-wave node-building functions especially in the third, and partially also in the second register. There must be found a compromise for tone, response and intonation. This is only possible through experiments and by trying.

Since the establishment of conical Boehm piccolos in the orchestral, 150 years ago, musicians have wanted a conical Boehm piccolo extending to low c ($c^1$) (sounding $c^2$). Thus nearly all prominent flute makers have worked on the problem, though without succeeding in developing an instrument that meets the timbre requirements for an orchestra. These instruments had, by deepening to deep $c^1$, in the first or low register difficulties with the sound and in the third octave problems with the intonation and especially with the response. This explains why piccolos were built not deeper than $d^1$.

Compositions by Benjamin Britten, Engelbert Humperdinck, Gustav Mahler, Ottorino Respighi, Arnold Schoenberg and Giuseppe Verdi call for a piccolo range extending to $c^1$. Particularly in contemporary music the piccolo is assuming an ever more important role as a solo instrument, e.g. in pieces by Franco Donatoni, Brian Ferneyhough, Jan Huylebroeck, Lowell Liebermann and Karlheinz Stockhausen.

However, without changes to the original compositions the current state of technology does not permit performance of such pieces utilising the timbre of the conical piccolo.

Science has not hitherto been in a position to fully explain the acoustic conditions of vibrating air columns enclosed in instrument tubes. It fails when it comes to giving the instrument maker absolute, reliably calculated figures. Thus constructing an instrument with good tuning and a beautiful sound remains a major problem that can only in part be resolved by using the calculated figures as a guideline, and can better be achieved through experiment and by use of empirically gained knowledge.

The totally different considerations regarding conical piccolos extending to low d ($d^1$) and conical piccolos extending to low c ($c^1$) stem from the fact that most of the parameters regarding woodwind instruments and in particular piccolos can not yet been explained. This is in part attributable to the fact that the flautist's anatomy is to a large extent integrated into and involved in creating the notes. The shaping of the lips, the embouchure and many other factors all play a role, and these considerations cannot easily be registered physically and mathematically. The factors and functions affecting the calculation are major and complex, and their influence has not yet been precisely grasped, thus no usable mathematical solutions are known to date. The conical piccolo going down to c1 does not just represent an extension of the model going down to $d^1$, but is an instrument whose entire construction must be developed using a completely new hole-setting scheme.

On the current state there are no scientific findings on which to base a method of calculation for establishing a hole-setting scheme for conical piccolos. The hole-setting scheme represents more than a known physico-mathematical relationship. There are no concrete solutions to be found in the literature. Proposals alone, as stated in the following literature, are not yet the solution to the problem. A piccolo constructed in accordance with such a proposal could not be used as a concert piccolo, and would at most be feasible as a mass-produced article, e.g. for educational purposes.

The known methods of calculation for establishing a tone-hole arrangement for a wind instrument or flute are laid down in scientific treatises, viz Otto Steinkopfs 'Zur Akustik der Blasinstrumente' [On the acoustics of wind instruments] (Celle 1983), C. N. Nederveen's 'Acoustical aspects of wood-wind instruments' (Amsterdam 1969) and A. H. Benade's 'On Woodwind Instrument Bores in Journal of the Acoustical Society of America', Vol. 31, No. 2, 18.11.1957. As regards the above statements, Steinkopf states on p 26 of the above book in the chapter 'The arrangement of the tone holes (Boehm flute)': "Totally reliable figures, however, are hardly to be expected in this context, thus one cannot entirely dispense with empirically gained knowledge."

The evidence for this can also be seen in the fact that the global market has not yet witnessed a usable conical piccolo extending to low c ($c^1$) and with only one $c^2$ hole. Instrument makers have long been seeking a resolution to this problem, and this invention forms the basis for such a resolution.

A further problem is that despite the fact that in 1939 international concert pitch was set at $a^1$=440 Hz in London, it has not been uniformly defined for all countries, thus different piccolos are still being built.

SUMMARY

An aspect of the present invention is to provide a piccolo that extends the timbre of the conical piccolo conventionally used exclusively down to low c ($c^1$), using simple and inexpensive means, and to design a conical piccolo of the above type extending to low c ($c^1$) in such a way as to achieve correct tuning coupled with evenness of tone and an equal sound in all three registers (octaves), an easier and more reliable response, especially in the difficult third octave, and the timbre to which musicians are accustomed, as with the conventional conical piccolo extending to low d ($d^1$).

In an embodiment, the present invention provides a piccolo including a cylindrical headjoint with an embouchure, a stopper including an adjustable seal disposed in a free end of the cylindrical headjoint, and a conical body having tone holes. The tone holes include a single tone hole corresponding to $c^2$ and an end tone hole at a free end of the conical body. The end tone hole is lower than the note $d^1$ and extends at least to the note $c^1$.

BRIEF DESCRIPTION OF THE DRAWINGS

Exemplary embodiments of the present invention are described in more detail below with reference to the drawing, in which:

FIG. 1 shows a piccolo in accordance with an embodiment of the invention.

DETAILED DESCRIPTION

Embodiments of the present invention address the above described aspects in that the body extending to low c ($c^1$) has been completely redesigned, and features only one thumb hole and an associated newly designed hole-setting scheme. The invention replaces the tonally inadequate attempts hitherto to design a conical piccolo extending to low c ($c^1$) and featuring two $c^2$ thumb holes—designs rejected by musicians.

This design, featuring only one $c^2$ thumb hole and extending to at least low c ($c^1$), allows provision of a new combination of tone holes—a so-called hole-setting scheme—by means of which the above-described previous disadvantages have been eliminated. The instrument's entire range displays an even sound, purity and excellent response, offering optimum artistic possibilities and boasting a timbre, feel and playability identical to those of the conical piccolo extending to low d ($d^1$).

One embodiment of the invention includes a hole-setting scheme with one $c^2$ tone hole for the thumb, extending to low c ($c^1$) and featuring the following dimensions for concert pitch $a^1$=440 Hz and closed g-sharp construction.

A hole setting scheme for tue concert pitch $a^1$=440 Hz with tue following distances between the mids of tue holes, measured from tue embouchure to the tone hole in question and stated in mm, is set forth in the following. The dimensions shown are representing the theoretical values of the length of the air column without consideration of a fine tuning (for example, due to changing temperatures or playing style):

d-sharp$^2$ (e-flat) tr.—84.30
$d^2$tr.—95.40
c-sharp$^2$ (d-flat)—105.00
$c^2$ (thumb hole)—116.00
$b^1$—126.70
a-sharp$^1$(b)—139.10
$a^1$—151.50
g-sharp$^1$ (a-flat) dpl.—160.50
g-sharp$^1$ (a-flat)—162.00
$g^1$—174.30
f-sharp$^1$ (g-flat)—186.70
$f^1$—199.20
$e^1$—216.50
d-sharp$^1$ (e-flat)—231.50
$d^1$—250.50
c-sharp$^1$—269.40
$c^1$ (end tone hole)—292.00
and with a maximal permissible deviation of +/−0.5%.
Tone-hole diameters in mm:
embouchure 8.50 and 10.50 (oval)
d-sharp$^2$ (e-flat) tr.—4.40
$d^2$tr.—4.40
c-sharp$^2$ (d-flat)—4.20
$c^2$ (thumb hole)—5.90
$b^1$—5.50
a-sharp$^1$ (b)—5.80
$a^1$—6.00
g-sharp$^1$ (a-flat)dpl.—5.90
g-sharp$^1$ (a-flat)—6.20
$g^1$ 6.40
f-sharp$^1$ (g-flat)—6.80
$f^1$—7.50
$e^1$—7.80
d-sharp$^1$ (e-flat)—7.70
$d^1$—7.90
c-sharp$^1$—7.90
$c^1$ (end hole)—8.80
And with a tolerance of +/−0.9 mm.

There are two basic piccolo designs: closed g-sharp key and open g-sharp key. With the open g-sharp design the same dimensions apply to the same concert pitch $a^1$, with the difference that the duplicate g-sharp tone hole, g-sharp$^1$ (a-flat) dpl., becomes superfluous and the g-sharp$^1$ (a-flat) tone hole is placed in the tone-hole row. The hole-setting scheme in accordance with certain embodiments of the invention also extends to such a design.

The hole-setting scheme is based on concert pitch $a^1$=440 Hz, though sounding an octave higher. As stated earlier, concert pitch is not the same everywhere, thus differing piccolos are built, deriving from a conventional hole-setting scheme. The lengths are inversely proportional to the number of vibrations.

The following already known conversion formula applies to frequencies other than concert pitch $a^1$=440 Hz:

The distance between the mid of the hole and between embouchure and tone hole for a new frequency [mm]= distance between the mid of the hole and between embouchure and tone hole [mm]×440 Hz divided by the new frequency [Hz]

FIG. 1. shows a top view of a conical piccolo with the keywork removed.

The conical piccolo depicted in the FIG. 1 includes two main parts, namely the cylindrical head (1) and the conical body (2). The cylindrical bore of the headjoint (1) and the conical bore of the body (2) are made visible using a sectional representation. A stopper (3) with adjustable seal is included. To facilitate fine tuning of the absolute pitch, e.g. in response to changing temperatures or playing style, the headjoint (1) and body (2) are equipped with interconnecting tubing such that adjustments can be made by sliding in and out. To achieve a higher pitch the distance between embouchure and tone hole is shortened/lengthened by sliding the tubing in/out, as shown by arrows 4 and 5.

The body (2) of a conical piccolo represented in the drawing is a closed g-sharp model, which has a second (duplicate) g-sharp hole: g-sharp dpl. It should be emphasised in this context that the new hole-setting scheme according to the invention for conical piccolos is equally advantageous whatever the material, be it wood, metal, plastic or a combination thereof. Designs are also possible that extend below $c^1$, and the body can be either single- or double-jointed (as with the concert flute).

While the invention has been particularly shown and described with reference to preferred embodiments thereof, it will be understood by those skilled in the art that various changes in form and details may be made therein without departing from the spirit and scope of the invention.

What is claimed is:

1. A piccolo comprising:

a cylindrical headjoint including an embouchure a stopper including an adjustable seal disposed in a free end of the cylindrical headjoint; and a conical body having tone holes including a single tone hole corresponding to $c^2$ and an end tone hole at a free end of the conical body, the end tone hole being lower than the note $d^1$ and extending at least to the note $c^1$, wherein the piccolo is in the family of orchestral Boehm flutes.

2. The piccolo recited in claim 1, wherein the tone holes include a hole-setting scheme for a concert pitch $a^1$=440 Hz, the scheme including the following respective distances between the mids of the tone holes, as measured from the embouchure to the respective tone hole in mm:

d-sharp$^2$ (e-flat) tr.—84.30

$d^2$tr.—95.40 c-sharp$^2$ (d-flat)—105.00

$c^2$ (thumb hole) 116.00

$b^1$—126.70 a-sharp$^1$(b)—139.10

$a^1$—151.50 g-sharp$^1$ (a-flat) dpl. (double)—160.50 g-sharp$^1$ (a-flat)—162.00

$g^1$—174.30 f-sharp$^1$ (g-flat)—186.70

$f^1$—199.20

$e^1$—216.50 d-sharp$^1$ (e-flat)—231.50

$d^1$—250.50 c-sharp$^1$—269.40

$c^1$ (end tone hole)—292.00 each hole having a maximal deviation of +/−0.5%.

3. The piccolo recited in claim 1, wherein the tone holes including the following respective diameters in mm:

embouchure—8.50 and 10.50 (oval), d-sharp$^2$ (e-flat) tr.—4.40, $d^2$tr.—4.40, c-sharp$^2$ (d-flat)—4.20, $c^2$ (thumb hole)—5.90, $b^1$—5.50, a-sharp$^1$ (b)—5.80, $a^1$—6.00, g-sharp$^1$ (a-flat)dpl. (double)—5.90, g-sharp$^1$ (a-flat)—6.20, $g^1$ 6.40, f-sharp$^1$ (g-flat)—6.80, $f^1$—7.50, $e^1$—7.80, d-sharp$^1$ (e-flat)—7.70, $d^1$—7.90, c-sharp$^1$—7.90, $c^1$ (end hole)—8.80, each hole having a tolerance of +/−0.9 mm.

4. The piccolo recited in claim 1, wherein the tone holes are arranged in accordance with a hole-setting scheme for tuning to a concert pitch corresponding to a first frequency, wherein a tuned distance between a center of the embouchure and a center of a tuned tone hole corresponds to a product of a relevant distance between the center of the embouchure and a center of the tone-hole for the concert pitch $a^1$=440 Hz and a ratio of 440 Hz to the first frequency.

5. The piccolo recited in claim 1, wherein the tone holes are arranged in accordance with a hole-setting scheme for tuning to a concert pitch corresponding to a first frequency, wherein a tuned distance between a center of the embouchure and a center of a tuned air-outlet hole corresponds to a product of a relevant distance between the center of the embouchure and a center of the air-outlet hole for the concert pitch $a^1$=440 Hz and a ratio of 440 Hz to the first frequency.

* * * * *